United States Patent [19]

Oguro

[11] Patent Number: 4,862,031

[45] Date of Patent: Aug. 29, 1989

[54] MAGNETRON CATHODE STRUCTURE

[75] Inventor: Tomokatsu Oguro, Mobara, Japan

[73] Assignee: Hitachi, Ltd., Tokyo, Japan

[21] Appl. No.: 16,409

[22] Filed: Feb. 19, 1987

[30] Foreign Application Priority Data

Mar. 19, 1986 [JP] Japan ..... 61-59134

[51] Int. Cl.[4] ..... H01J 1/15

[52] U.S. Cl. ..... 313/341; 313/257; 313/340

[58] Field of Search ..... 313/341, 257, 274, 277; 315/39.51; 174/152; 403/179

[56] References Cited

U.S. PATENT DOCUMENTS 3,979,187 9/1976 Scherer ..... 174/152 GM 4,558,250 12/1985 Tsuzurabara ..... 313/341

4,684,845 8/1987 Tsuzurahara et al. ..... 313/257

*Primary Examiner*—Robert L. Griffin

*Assistant Examiner*—T. Salindong

*Attorney, Agent, or Firm*—Antonelli, Terry & Wands

[57] ABSTRACT

A cathode structure of a magnetron which is used for microwave ovens, industrial microwave heating, and medical purposes is disclosed. One of two leads of the cathode structure of the magnetron, that is, one of a center lead and a side lead is tightly fitted into the spacer, and a metal fixing material is poured into the fitting portion and is fixed thereto. A hole of the spacer for inserting the other of the two leads has looseness with respect to the other of the two leads. The friction between the other of the two leads and the spacer is reduced, and even when the leads are made thin, the strength of the cathode structure is not reduced, and the production of extraneous sounds can be suppressed.

12 Claims, 5 Drawing Sheets

MAGNETRON CATHODE STRUCTURE

BACKGROUND OF THE INVENTION

1. Field of the Invention

The present invention relates to a cathode structure of a magnetron for microwave ovens, industrial microwave heating, and medical use.

2. Description of the Prior Art

FIG. 1A shows a longitudinal sectional view of a tube main body of a magnetron used generally in microwave ovens and the like. In FIG. 1A, reference numeral 1 designates a cathode for emitting electrons, 2 designates an anode having cavity resonators formed therein, and there are provided with magnetic pole pieces 3, 4 for concentrating magnetic line of force applied from the outside of the tube main body into an operating space formed by the cathode 1 and the anode 2. Sealing cylinders 5, 6 abut respectively against opposite ends of a cylindrical portion of the anode 2 to enclose the magnetic poles 3, 4. Further, a ceramic member serving as a sealing member supports the cathode 1, and a stem ceramic 8 is joined with the sealing cylinder 5 together with a cathode terminal 7 which supplies a cathode current. And an exhaust pipe support 11 holding an exhaust pipe 10 enclosing an antenna 9 extending from a specific vane of the anode 2 is joined with an antenna ceramic 12 serving as a radiation window of the generated microwaves, and the antenna ceramic 12 is in turn joined with the sealing cylinder 6.

FIG. 1B is a longitudinal sectional view of the prior art cathode structure of the magnetron shown in FIG. 1A.

In FIG. 1B, a filament 22 of a spiral shape made of Th—W (thoriated tungsten) constituting the cathode 1 is supported and fixed at its opposite ends respectively to an upper end shield 23 and a lower end shield 24. The upper end shield 23 is secured to a center lead 26, and the lower end shield 24 is secured to a side lead 25, and these leads 25, 26 are respectively inserted into holes **27*a*, 27*a* of an insulating ceramic 27 to pass therethrough. Extending ends of the leads 25, 26 are secured air tightly to the cathode terminal 7 made of a metal fixed to a metallized portion formed at an outer end of the ceramic 27. The sealing cylinder 5 made of a metal has one end secured air tightly to the insulating ceramic 27, and the other end of the sealing cylinder 5 is fixed to the anode 2 (FIG. 1A) to mechanically hold the magnetron and to shield from the atmosphere. The reference numeral 28 designates a spacer made of ceramic, and FIGS. 1C and 1D are respectively a plane view and a longitudinal sectional view. In FIGS. 1C and 1D, the spacer 28 has two spacer holes 28*a* and 28*b*, and the side lead 25 is inserted into the spacer hole 28*a* and the center lead 26 is inserted into the spacer hold 28*b* to suppress the movements of both leads 25, 26 and to reinforce the securing of both leads 25, 26**.

Such a cathode structure of a magnetron is disclosed, for example in JP-A-54-109364 (Japanese Patent Laid-Open Publication No. 54-109364).

Recently, as the microwave ovens are widely used, inexpensive, small sized, and light magnetrons have been needed. In the cathode structure of the magnetron, as shown in FIGS. 1A and 1B, two leads 25, 26 of expensive molybdenum bars have been used as a support of the cathode structure.

As a result, when the leads are made thin to save the material, the vibration-resistant property and the high-impact property of the cathode will be degraded. Furthermore, in order to increase the mechanical strength, two leads 25, 26 are inserted into the spacer 28, and thus, when the thermal expansion of the leads 25, 26 occurs, the leads 25, 26 and the spacer 28 move under frictional resistance relative to each other, and extraneous sounds have been produced.

In other words, in the prior art structure shown in FIGS. 1B, 1C and 1D, the following drawbacks have been involved.

(1) Since the spacer is permitted to rotate relative to the leads, the degree of freedom of movement of the leads is considerably large.

(2) When the looseness between the spacer hole and the leads is made small, the breakdown strength of the cathode against vibrations is increased, however, the extraneous sounds are easily produced.

(3) The spacer 28 is inclined also in the axial direction about a supporting point, that is, a metal sleeve 29 which is a stopper. Thus, even when the looseness is made large, the frictional resistance between the spacer and the leads is not prevented, and the extraneous sounds are produced.

SUMMARY OF THE INVENTION

An object of the present invention is to provide a cathode structure of a magnetron in which the strength of the cathode structure is not decreased even when the leads are made thin, and in which the production of extraneous sounds due to the movement of the spacer and the leads under the frictional resistance is prevented.

In the present invention, in order to achieve the aforementioned object, one of the two leads of the cathode structure of the magnetron is fitted into the spacer tightly, and a metal fixing material such as a metal solder or the like is poured into the fitting portion to be made secured thereto thereby to inhibit the movement of the lead relative to the spacer, and the other of the holes of the spacer is made to have looseness with respect to the other lead.

As described above, in fitting the two leads into the spacer, one lead is relatively secured to the spacer, and the other lead is fitted with large looseness into the spacer. As a result, it is possible to reduce the friction, the strength of the cathode is not decreased even when the leads are made thin, and it is possible to suppress the production of the extraneous sounds.

BRIEF DESCRIPTION OF THE DRAWINGS

Preferred embodiments of the present invention will now be described in conjunction with the accompanying drawings, in which.

DESCRIPTION OF THE PREFERRED EMBODIMENTS

Hereinafter, a cathode structure of a magnetron in accordance with the present invention will be described in detail by way of embodiments.

Figure 2A:
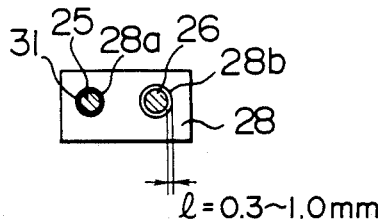
FIGS. 2A and 2B are respectively a plane view and longitudinal sectional view of a spacer portion of a first embodiment of the present invention.
Figure 2B:
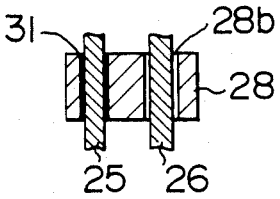

FIGS. 2A and 2B are a plane view and longitudinal sectional view of a cathode structure of a magnetron according to the present invention.

In FIGS. 2A and 2B, the fitting of one of the two leads, that is, a side lead 25 into a spacer hole 28*a* is made to have relatively small looseness enough to strongly tighten the side lead 25, and a metal fixing material 31 including a metal solder material, or a pasty metal powder and the like is poured into or spread on the fitting portion, and it is fixed or sintered. The other spacer hole 28*b* is made to have a large looseness l' with respect to a diameter of the other lead, that is, a center lead 26, for example, by setting the looseness, l'=0.3–1.0 mm or so, extraneous sounds are not produced.

Figure 3A:
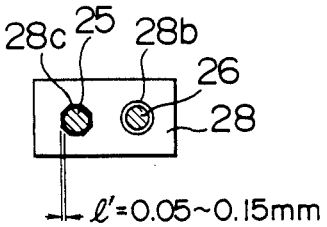
FIGS. 3A and 3B are respectively a plane view and longitudinal sectional view of a spacer portion of a second embodiment of the present invention.
Figure 3B:
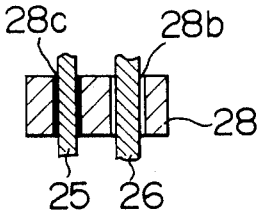

FIGS. 3A and 3B are a plane view and longitudinal sectional view of a spacer portion of a second embodiment of the cathode structure of the magnetron according to the present invention.

Figure 1A:
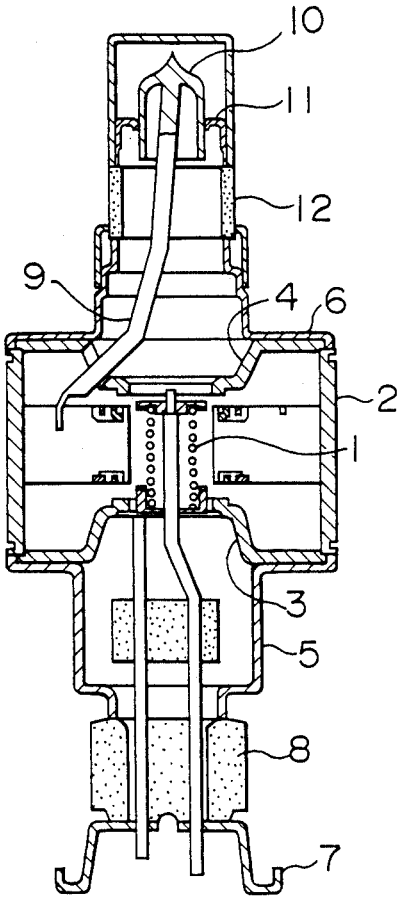
FIG. 1A PRIOR ART
FIG. 1A longitudinal sectional view of a prior art magnetron tube main body.
Figure 1B:
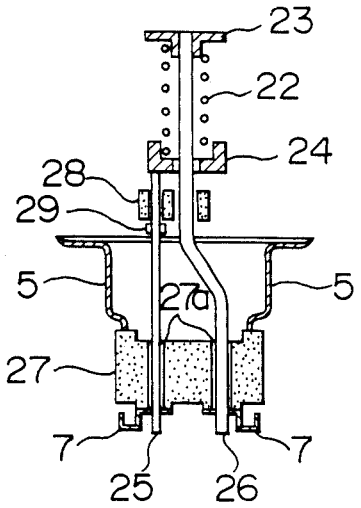
FIG. 1B PRIOR ART
FIG. 1B is a longitudinal sectional view of the cathode structure in FIG. 1A.
Figure 1C:
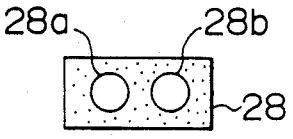
FIG. 1C PRIOR ART
FIGS. 1C and 1D are respectively a plane view and longitudinal sectional view of the prior art spacer used in the structure of FIG. 1B.
Figure 1D:
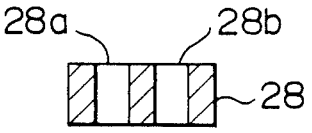
FIG. 1D PRIOR ART
Figure 3C:
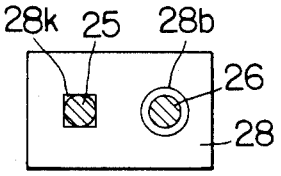
FIGS. 3C and 3D are , respectively, a plane view and longitudinal sectional view of a variation of the second embodiment
Figure 3D:
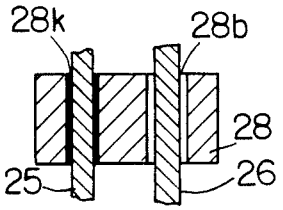

In FIGS. 3A and 3B, a spacer hole 28c is formed in a polygon shape (or polygon), and a minimum inner diameter of the spacer hole 28c has small looseness l', for example, l'=0.05–0.15 mm or so with respect to a diameter of a side lead 25. FIGS. 3C and 3D show a spacer hole 28K formed in a rectangular shape. When such a spacer is assembled in the cathode structure shown in FIG. 1B, advantages are obtained including;

1 since the side lead 25 is fitted into the spacer 28 tightly, the inclination of the spacer 28 in the axial direction is small. In addition, since the center lead 26 is fitted into the spacer 28 very loosely, even when the center lead 26 and the spacer 28 move relative to each other under frictional resistance due to thermal expansion, a chance of producing extraneous sounds is very rare, and 2 due to the tight fitting of the side lead 25 into the spacer 28, a relative displacement of the two leads is suppressed, and the strength and a vibration-resistant property are increased.

Figure 4A:
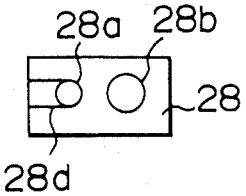
FIGS. 4A and 4B are respectively plane view and longitudinal sectional view of a spacer portion of a third embodiment of the present invention.
Figure 5A:
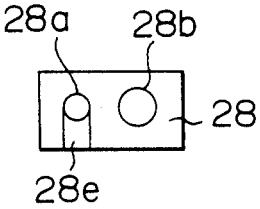
FIGS. 5A and 5B are respectively a plane and longitudinal sectional view of a spacer portion of a fourth embodiment of the present invention.
Figure 4B:
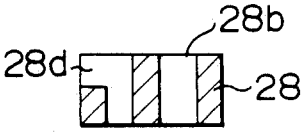
Figure 5B:
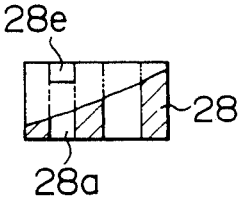

FIGS. 4A and 4B are a plane view and longitudinal sectional view of a spacer of a third embodiment, and FIGS. 5A and 5B are a plane view and longitudinal sectional view of a spacer of a cathode structure of magnetron of a fourth embodiment of the present invention.

In FIGS. 4A and 4B, a recess portion 28*d* is formed in a part of the spacer 28 adjacent to a spacer hole 28*a* in the lengthwise direction so that the recess portion 28*d* is connected to the spacer hole 28*a* at one end thereof. A width of the recess portion 28*d* is substantially equal to the diameter of the spacer hole 28*a*.

In contrast in FIGS. 5A and 5B, a recess portion 28*e* is formed in a part of the spacer 28 adjacent to a spacer hole 28*a* in a direction at right angles to the lengthwise direction so that the recess portion 28*e* is connected to a spacer hole 28*a*. Also in this case, a width of the recess portion 28*e* is equal to the diameter of the space hole 28*a*. These recess portions 28*d* and 28*e* limit the coating area of a metal fixing material 31, and easily prevent the electrical short-circuit between the leads.

Figure 6A:
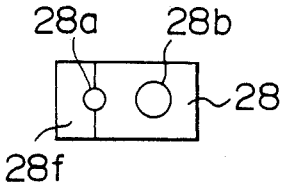
FIGS. 6A and 6B respectively a plane view and longitudinal sectional view of a spacer portion of a fifth embodiment the present invention.
Figure 6B:
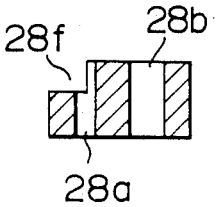

FIGS. 6A and 6B are a plane view and longitudinal sectional view of a spacer portion of a fifth embodiment of the present invention, in which a recess portion 28*f* is formed in the upper surface of the spacer 28 so that one side of the recess portion 28*f* passes through the center of a spacer hole 28*a* in a direction at right angles to the lengthwise direction. In this case, as is the case in FIGS. 4A and 4B, the flowing out of a metal fixing material 31 is prevented, and further, the short circuiting between a side lead 25 and a center lead 26 due to the metal fixing material 31 is prevented.

Figure 7:
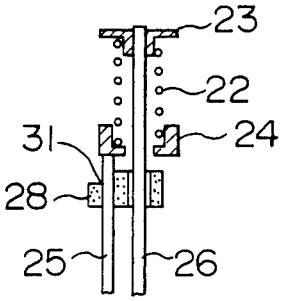
FIG. 7 is a sectional view of an assembly of a principal part of a, cathode structure in accordance with the present invention FIGS. 8A and 8B respectively a plane view and longitudinal sectional view of a spacer portion of a sixth embodiment of the present invention.

FIG. 7 is a sectional view of the cathode structure in which the spacer 28 having the recess portion 28*d*, 28*e*, or 28*f* in FIGS. 4,5, and 6 is used.

In FIG. 7, a solder material such as a Ru-Mo material, a Ru-Mo-Ni material, or a Ni material is pasted and spread on the recess portion 28*d*, 28*e*, or 28*f*, and then the solder material is fused and fixed. Alternatively, a pasted Mo powder is spread on the recess portion and it is sintered. By pouring such a metal fixing material 31 on the outer surface of the side lead 25 at the position of the recess portion 28*d*, a gap between the spacer hole 28*a* and the side lead 25 is filled with the metal fixing material 31, and it is possible to inhibit the relative movement between the spacer 28 and the side lead 25.

In this case, if the spacer holes 28*c* and 28*k* are in the polygon shape or rectangular shape as shown in FIGS. 3A and 3B, and FIGS. 3C and 3D, respectively, the rotation of the spacer 28 can be suppressed more firmly. The metal fixing material 31 may naturally be applied to the spacer 28 shown in FIGS. 3A and 3B, however, if the recess portion is formed in the spacer as shown in FIGS. 4A, 4B–6A, 6B, the metal fixing material 31 can be poured more easily into an optimum portion, and thus, there is little fear of causing short-circuiting between both leads 25 and 26 due to excessive spreading of the metal fixing material 31 on an unrequired portion on the surface of the spacer 28.

Further, the spacer hole 28a shown in FIGS. 4A, 4B–6A, 6B may be formed in the rectangular shape (or polygon), and the spreading of the metal fixing material 31 on the fitting portion of the side lead 25 with respect to the spacer 28 shown in FIG. 7 and the sintering of the metal fixing material 31 may be carried out simultaneously with the assembling of a filament, etc., or the spreading and sintering of the metal fixing material 31 may be carried out beforehand in relation to the side lead 25 and the spacer 28.

Figure 8A:
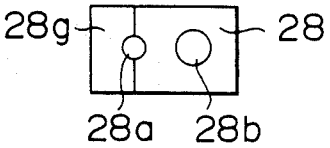
Figure 8B:
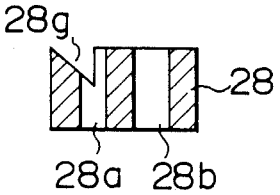

Lastly, FIGS. 8A, 8B, -10A, 10B show various recess portions formed in the spacer 28. In other words, FIGS. 8A and 8B are a plane view and longitudinal sectional view of a spacer portion of a sixth embodiment of the present invention, a recess portion **28*g* is formed in the upper surface of the spacer 28 from one side thereof adjacent to a spacer hole 28*a* downwardly towards the center of a spacer hole 28*a*. That is, the bottom surface of the recess portion 28*g* is inclined from the one side of the spacer 28 towards the center of the spacer hole 28*a***.

Figure 9A:
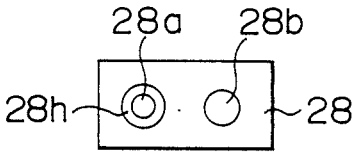
FIGS. 9A and 9B are respectively a plane view and longitudinal sectional view of a spacer portion of a seventh embodiment of the present invention.
Figure 9B:
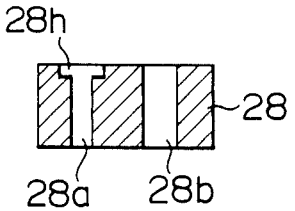

Next, FIGS. 9A and 9B are a plane view and longitudinal sectional view of a spacer portion of a seventh embodiment of the present invention, in which a recess portion **28*h* is formed in the upper surface of the spacer 28 circularly and coaxially with a spacer hole 8*a***.

Figure 10A:
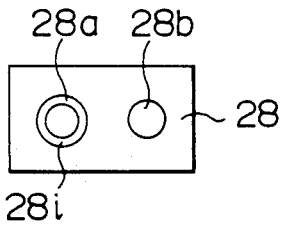
FIGS. 10A and 10B are respectively a plane view and longitudinal sectional view of an eighth embodiment of the present invention.

Further, FIGS. 10A and 10 are a plane view and longitudinal sectional view of a spacer portion of an eighth embodiment of present invention, in which a recess portion **28*i* is formed in the upper surface of a spacer 28 in a countersink shape coaxially with a spacer hole 28*a*, and in the longitudinal section of spacer, the recess portion 28*i*** is in an arcuate shape.

Figure 11A:
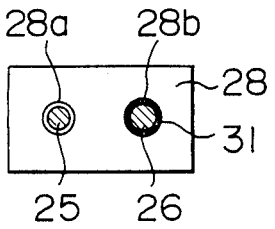
FIGS. 11A and 11B respectively a plane view and longitudinal sectional view of a spacer portion in which positional relationships of the two leads in FIGS. 2A and 2B are reversed.
Figure 10B:
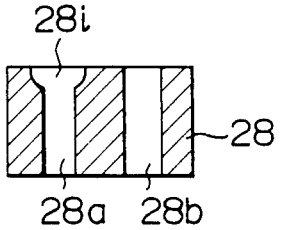
Figure 11B:
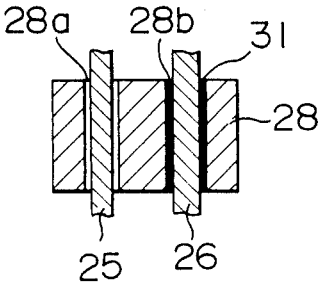

Further, in the embodiments described in the foregoing, the description of the fixing is made only in relation to the spacer and the side lead. However, the present is not limited to this, and as shown in FIGS. 11A and 11B, the center lead 26 may be fixed, and the side lead 25 may be fitted into a spacer hole **28*a*** with looseness therebetween.

As described in the foregoing, the present invention provides advantages in that since the engagement between one of the two leads and the spacer is tightened, the cathode structure is good in the vibration resistant property and the high-impact property. Moreover, since the other lead and the spacer hole have large looseness therebetween, there is no portion causing the friction therebetween, the extraneous sounds are not produced, and even when the diameter of the leads is reduced, sufficient strength can be insured. Thus, a magnetron which is inexpensive and which exhibits high performance can be obtained.

We claim:

1. In a cathode structure of a magnetron comprising a cathode filament, an upper end shield and a lower end shield respectively secured to upper and lower ends of said cathode filament, a center lead having one end secured to said upper end shield and extending downwardly passing through the centers of said cathode filament and said lower end shield, a side lead having one end secured to said lower end shield and extending substantially in parallel with said center lead, and a spacer made of a ceramic material and having two holes into which said side lead and said center lead are inserted, an improvement in which in fitting said side lead and said center lead respectively into said two holes of said spacer, one of said side lead and said center lead is fitted into a corresponding one of said two holes with a large looseness with respect to said one of said two holes when said one of said side lead and said center lead is fitted therein, and the other of said side lead and said center lead is fitted into the other of said two holes with small looseness as far as possible with respect to said other of said two holes when said other of said side lead and said center lead is fitted therein, wherein a portion of said other of said side lead and said center lead fitted into said other of said two holes with small looseness is fixedly secured therein, and said one of said side lead and said center lead fitted into said one of said two holes with a large looseness is relatively movable with respect thereto so that friction between said one of said side lead and said center lead and said spacer is reduced, and the production of extraneous sounds is suppressed.

2. A cathode structure of a magnetron according to claim 1, wherein in the fitting of said other of said leads into said other of said two holes having the small looseness, a metal fixing material including a metal solder material or a pasted metal powder is fixed or sintered so as to strongly tighten said other of said leads therein.

3. A cathode structure according to claim 1 wherein said other of said two holes having the small looseness is formed in a rectangular shape.

4. A cathode structure according to claim 1 wherein a recess portion is formed in an upper surface of said spacer at one end portion thereof adjacent to a other of said two holes having the small looseness, and said metal fixing material is attached to said recess portion and said lead inserted into said other of said two holes thereby to fix or sinter said metal fixing material.

5. A cathode structure according to claim 1 wherein a recess portion is formed in an upper surface of said spacer at one end portion thereof adjacent to said other of said two holes having the small looseness in a lengthwise direction of said spacer so that said recess portion is connected to said other of said two holes, and a metal fixing material is attached to said recess portion and said lead inserted into said other of said two holes thereby to fix or sinter said metal fixing material.

6. A cathode structure according to claim 1 wherein a recess portion is formed in an upper surface of said spacer at one end portion thereof adjacent to said other of said two holes having the small looseness in a direction at right angles to a lengthwise direction of said spacer so that said recess portion is connected to said other of a two holes, and said metal fixing material is attached to said recess portion and said lead inserted into said other of said two holes thereby to fix or sinter said metal fixing material.

7. A cathode structure according to claim 1 wherein a recess portion is formed in an upper surface of said spacer at one end portion thereof adjacent to said other of said two holes having the small looseness in a direction at right angles to a lengthwise direction of said spacer so that one side of said recess portion passes through a center of said other of said two holes, and a metal fixing material is attached to said recess portion and said lead inserted into said other of said two holes thereby to fix or sinter said metal fixing material.

8. A cathode structure according to claim 1 wherein a recess portion is formed in an upper surface of said spacer at one end portion thereof adjacent to said other of said two holes having the small looseness in a direction at right angles to a lengthwise direction of said spacer so that one side of said recess portion passes through a center of said other of said two holes and a bottom surface of said recess portion is inclined downwardly towards the center of said other of said two holes, and a metal fixing material is attached to said recess portion and said lead inserted into said other of said two holes thereby to fix or sinter said metal fixing material.

9. A cathode structure according to claim 1 wherein a circular recess portion is formed in an upper surface of said spacer coaxially with said other of said two holes having the small looseness, and metal fixing material is attached to said recess portion and said lead inserted into said other of said two holes thereby to fix or sinter said metal fixing material.

10. A cathode structure according to claim 1 wherein a recess portion is formed in an upper surface of said spacer in a countersink shape coaxially with said other of said two holes having the small looseness, and a metal fixing material is attached to said recess portion and said lead inserted into said other of said two holes thereby to fix or sinter said metal fixing material.

11. A cathode structure according to claim 2 wherein said metal fixing material is made of any one selected from the group including Ru, Mo, and Ni.

12. A cathode structure of a magnetron according to claim 1, wherein a portion of said side lead and a portion of said center lead fitted into respective ones of said two holes of said spacer are non-bent lead portions throughout the entire length of said two holes of said spacer.

* * * * *